United States Patent [19]

Junior et al.

[11] Patent Number: 4,748,815

[45] Date of Patent: Jun. 7, 1988

[54] STEAM TURBINE SYSTEM

[75] Inventors: Alfred Junior, Langenhagen; Walter Aumann, Wiedensahl, both of Fed. Rep. of Germany

[73] Assignee: Korting Hannover Aktiengesellschaft, Fed. Rep. of Germany

[21] Appl. No.: 83,447

[22] Filed: Aug. 10, 1987

[30] Foreign Application Priority Data

Aug. 20, 1986 [DE] Fed. Rep. of Germany ..... 3628186
Jun. 13, 1987 [DE] Fed. Rep. of Germany ..... 3719861

[51] Int. Cl.[4] ..... F01K 9/02

[52] U.S. Cl. ..... 60/692; 60/657; 60/691

[58] Field of Search ..... 60/646, 657, 685, 689, 60/690, 692, 691

[56] References Cited

U.S. PATENT DOCUMENTS 2,707,239 4/1955 Riehl ..... 60/691 X

FOREIGN PATENT DOCUMENTS 234581 6/1925 United Kingdom ..... 60/690

*Primary Examiner*—Stephen F. Husar

*Attorney, Agent, or Firm*—Allegretti, Newitt, Witcoff & McAndrews, Ltd.

[57] ABSTRACT

An extraction turbine system in which the condenser connects to a venting system to remove non-condensing air flows penetrating the system and gases entrained in the steam and condensate and a portion of exhaust steam. The venting system has a steam jet compressor to provide the suction for removing the gases and steam. The motive end of the compressor is fed by a steam line connecting to the lowest pressure extraction point on the turbine (next to the turbine exhaust point), which pressure is below atmospheric. This construction reduces the power requirement for removing the gases and steam; it recovers heat energy from the steam exhausted from the turbine, preheats the condensate, and correspondingly gains additional mechanical energy from the turbine.

3 Claims, 1 Drawing Sheet

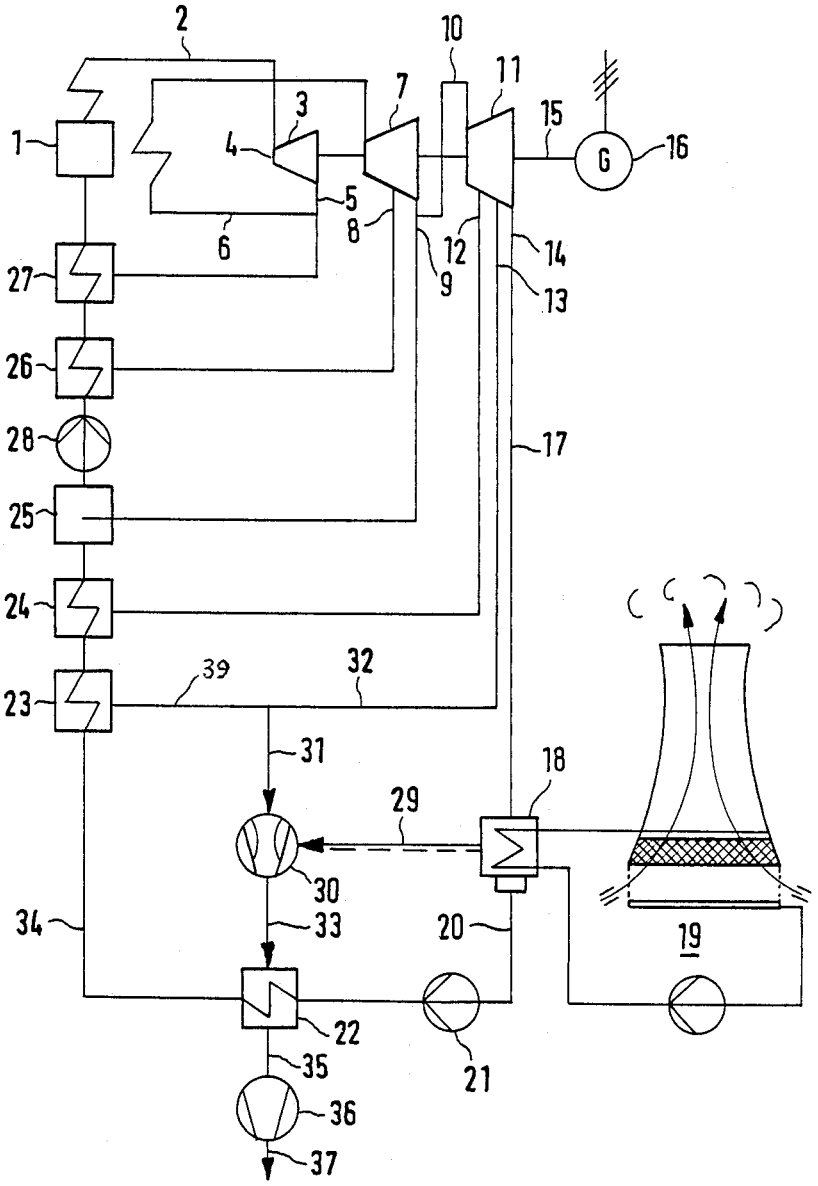
2
10
11
7
3
15
1
4
G
16
5
8
12
14
6
9
13
27
26
17
28
25
24
39
32
23
31
18
29
30
34
33
20
19
22
35
21
36
37

STEAM TURBINE SYSTEM

The invention concerns an extraction type steam turbine system having an improved, more efficient means for removing gases from the condensate.

PRIOR ART

It is generally known to ventilate condensers in steam turbine plants. Various methods for ventilation are known, for example, from the article "Wirtschaftliche Entluftung von Dampfturbinenkondensatoren" ("Economical Ventilation of Steam Turbine Condensers"), by A. Junior in the publication of the firm Korting Hannover AG, dated 1978. Ventilation has the goal of removing infiltrated air from the vacuum side of the steam turbine. Despite the most painstaking sealing of part joints, shaft seals, connecting flanges, and despite a flawless execution of all welding seams, it is unavoidable that small air flows penetrate the system. Also, the steam brings some air and other gases along with it. These non-condensing components must be suctioned off from the condenser, so that the greatest possible power with a given steam turbine device can be attained.

The publication mentioned discloses combinations of steam jet compressors and connected suction pumps for the purpose of suction. The drive steam for the steam jet compressor is supplied from a bleeder on the turbine, the pressure of which, during all operating conditions of the turbine, lies above atmospheric pressure. This means that a relatively high power requirement is needed to operate the steam jet compressor.

In German patent specification No. 514 718, single and multiple stage steam jet vacuum pumps are described, which compress up to atmospheric pressure, and are connected on the motive steam end, to an extraction point on the turbine. Here, too, however, only those extraction lines can be used, which, during all operating conditions of the steam turbine, lie above atmospheric pressure. Thus, a relatively high power requirement is necessary for operation.

In the article by A. Junior, "Die Dampfstrahl-Vakuum-pumpe als Warmepumpe bei der Evakuierung eines Dampfturbinenkondensators" ("The Steam Jet Vacuum Pump as a Heat Pump in the Evacuation of a Steam Turbine Condenser"), in the periodical "Kraftwerkstechnik" ("Power Plant Technology"), September 1985, pages 829–835, it is described that, in a steam turbine device, a heat exchanger is usually connected between the steam jet compressor and the suction pump, in which heat exchanger the motive and suction steam flowing from the steam jet compressor condense. This intermediate heat exchanger is, on the water end, so connected into the feed water cycle, that it lies downstream of the main condensate pump, and upstream of the first feed water heater. It serves partially to heat condensate prior to the first feed water heater. The total bleeder steam flow heats the condensate partially in the intermediate heat exchanger as first stage of feed water heating by means of motive steam of the steam jet compressor (this is bleeder steam) and by means of suction steam from the condenser (this is recovered heat energy) and partially in the first feed water heater to a preset nominal value. Compared to the original total bleed steam flow, this new bleed steam flow is thereby reduced by a portion of steam the heat energy of which corresponds to that of the suction steam flow from the condenser. This portion of the bleeder steam no longer required for the feed water heating flows through the end stages of the turbine, so that a corresponding portion of the energy is regained.

The energy expended for the steam jet compressor and suction pump, reduced by this regained portion of the energy, is the effective energy or power, expended for the suction. The effective power requirement will vary, depending on the pressure and the temperature of the motive steam used for the steam jet compressor. The power requirement is lower when the pressure and temperature of motive steam are lower and larger when the steam flow is suctioned from the turbine condenser. It is always taken as the starting point in the prior art that the motive steam pressure is above atmospheric pressure, so that a considerable power requirement is needed for effecting the suction.

THE INVENTION

The object of the invention is to provide a steam turbine plant or system of the type described, the overall efficiency of which is greater than that of the steam turbine systems described in the prior art.

The basic concept of the invention lies in taking a portion of the bleeder steam from the extraction point with the lowest bleeder pressure (next to the exhaust point of the turbine) as the motive steam for the steam jet compressor. In prior systems, the bleeder steam was used solely in the steam turbine cycle for preheating of condensate or feed water. In accordance with the invention, a heat exchanger connects to the exhaust line (compression end) of the jet compressor for preheating condensate pumped from the condenser. Thus, the bleeder steam not only preheats the condensate, but additionally powers the compressor. Through this, the overall efficiency of the steam turbine device is increased. The pressure of this bleeder steam during the different operating conditions of the steam turbine device, continuously or temporarily, lies below atmospheric pressure.

No additional power, therefore, is needed for the opeation of the steam jet compressor; that is, the effective power requirement for the steam jet compressor is evaluated as zero.

In one particularly economical arrangement the drive end of the steam jet compressor is connected to the extraction point without the interposition of a pressure regulator, that is to say, the drive steam pressure in the steam line flowing to the compressor depends solely on the turbine load, and changes correspondingly.

The suction devices are usually constructed in steam turbine devices in accordance with guidelines which are different in different countries. Examples of such guidelines are, for example, the following:

Germany: "Empfehlung fur Auslegung und Betrieb von Vakuum-pumpen bei Dampfturbinen-Kondensatoren" ("Recommendation for the Construction and Operation of Vacuum Pumps in Steam Turbine Condensers"), VGB-R 126 L, 2nd revised edition, 1986, issued by the VGB Technische Vereinigung der Grosskraftwerksbetriebe, which can be obtained from: VGB-Kraftwerkstechnik, Klinkestrabe 27-31, D-4300 Essen.

U.S.A.: "Standards for Steam Surface Condensers", Seventh Edition, Copyright Jan. 1, 1978, by: Heat Exchange Institute, 1230 Keith Building, Cleveland, OH, 44115.

Great "Recommended Practice for the Design of Surface Type Steam Britain: Condensing Plant", Publication No. 222, 1967: The British Electrical and Allied Manufacturers' Association (Incorporated), 8 Leicester Street, London WC2.

It is the objective of all these guidelines to determine a minimum size of the suction stream for the size of each turbine plant in order to ensure a flawless condensation process. This objective was achieved in the previously-known devices, only by means of additional power consumption.

It is surprising that, in accordance with the invention, namely, using bleeder steam from the extraction point with the lowest pressure (next to the exhaust point of the turbine) as the motive steam for the steam jet compressor, it is no problem to obtain, not only the minimum suction flows recommended in the publications stated above, without additional expenditure of power, but even to considerably exceed these. Since the steam jet compressor has a power requirement which can be served from the potential energy of the bleeder steam from the extraction point with the lowest pressure, which power as indicated above, in the overall energy balance can be evaluated as being zero, there exists the possibility here of going to the furthest limit with the dimensioning of the steam jet compressor. For example, in accordance with the theory of the invention, the jet compressor is dimensionsed so that the outlet pressure of the jet compressor, that is, the pressure in the heat exchanger is at least 25%, preferably more than 50%, of the bleeder steam pressure, so that the steam suction flow from the condenser is at a maximum.

In addition to the recovered portion of power, the increased steam suction power improves the flow conditions in the turbine condenser, and reduces the gas partial pressure, and thereby the oxygen partial pressure as well. Through this, there result additional positive improvements in the operation of the turbine condenser, such as:

Reduction of the condensation pressure, and through this an increased power yield;

Reduction of possible condensate supercooling;

Reduction of corrosion.

DETAILED DESCRIPTION

The invention is illustrated in greater detail in the example of execution depicted in the drawing showing a flow chart for a steam turbine plant constructed in accordance with the invention.

A boiler 1 is connected by means of a line 2 with a high-pressure stage 3 of a steam turbine 4. The turbine has a plurality of extraction points 5, 8, 9, 12, 13 and the exhaust point 14. Point 5 is connected with a middle pressure stage 7 by means of a line 6. Stage 7 has two extraction points 8, 9, the latter being connected with a low pressure stage 11 by means of a line 10. Stage 11 has extraction points 12, 13, and the exhaust point 14. Shaft 15 of the steam turbine 4 is connected to an electrical generator 16.

The exhaust point 14 is the exhaust end of the steam turbine 4, and is connected with a condenser 18 by means of a line 17 in which the exhaust steam is condensed in the known manner. The circulating medium flowing through condenser 18 is e.g. air cooled by means of a cooling tower 19.

The condensate from the condenser 18 goes through a line 20, a condensate pump 21, a heat exchanger 22, as well as through feed water heaters 23 through 27, and a feed water pump 28, and then back into the boiler 1.

From the condenser 18, a suction line 29 leads to the suction end of a steam jet compressor 30 to draw gases and steam from the condenser. The motive end of the compressor is fed through lines 31, 32, which connects with the extraction point 13, which is the extraction point having the lowest bleeder steam pressure except for the exhaust pressure at the exhaust point 14. A portion of bleeder steam from line 32 flows through line 39 to first feed water heater 23. The pressure at the extraction point 13, during the different operational conditions of the steam turbine unit, lies continuously or temporarily below atmospheric. The motive end of the steam jet compressor 30 is therefore fed with a partial flow of the bleeder steam from the extraction point 13.

The compression or exhaust end of the steam jet compressor 30 is connected with the heat exchanger 22 by means of a line 33. This heat exchanger lies ina line 34 downstream behind the condenser 18 between condensate pump 21 and the first feed water heater 23. A suction pump 36 is connected to the heat exchanger 22 by means of a suction line 35. This pump can be a water ring pump, a water jet pump, a steam jet pump, or a combination of these. The outlet 37 connects with the atmosphere.

What is claimed is:

1. In a power generating steam turbine plant comprising a multistage steam turbine having a feed end and an exhaust end a boiler for feeding steam to said feed end a condenser connecting to said exhaust end a series of feed water heaters for preheating feed water for said boiler a plurality of extraction points on said turbine to bleed steam therefrom to supply heat to said feed water heaters an improved means for evacuating said condenser comprising a steam jet compressor having a motive end, a suction end and a compression end said motive end being connected to the extraction point having the lowest bleed pressure next to the exhaust pressure said suction end being connected to said condenser a heat exchanger connected in series between said condenser and the first in said series of feed water heaters, said heat exchanger having an inlet and an outlet, said inlet being connected to said compression end of the compressor and said outlet being connected to the atmosphere through a suction pump.

2. The improved means for evacuating condensate of claim 1 in which steam pressure on said motive end of the compressor varies solely with the turbine load.

3. The improved means for evacuating the condenser of claim 1 in which said compressor is dimensioned so that the steam pressure at its exhaust end is equal to at least 25% and preferably greater than 50% of the steam pressure at said lowest bleed pressure extraction point which is next to the exhaust point.

* * * * *